US006657148B2

(12) United States Patent
Thizon

(10) Patent No.: US 6,657,148 B2
(45) Date of Patent: Dec. 2, 2003

(54) MULTIPOLE CONTACT BLOCK

(75) Inventor: Patrice Thizon, Ruelle-sur-Touvre (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 10/084,512

(22) Filed: Feb. 28, 2002

(65) Prior Publication Data

US 2002/0125121 A1 Sep. 12, 2002

(30) Foreign Application Priority Data

Mar. 9, 2001 (FR) ..... 01 03278

(51) Int. Cl.[7] ..... H01H 3/14
(52) U.S. Cl. ..... 200/520; 200/16 A
(58) Field of Search ..... 200/16 A, 280, 200/281, 243, 520, 16 R, 405, 440, 441, 442, 446, 447, 449, 462, 467, 16 C

(56) References Cited

U.S. PATENT DOCUMENTS 3,544,929 A 12/1970 Di Marco et al. ..... 335/126
4,276,458 A * 6/1981 Alter ..... 200/245
4,306,123 A * 12/1981 Taylor ..... 200/16 A
4,634,820 A * 1/1987 Noguchi ..... 200/16 A
6,114,639 A 9/2000 Hall et al. ..... 200/16 A
6,198,058 B1 * 3/2001 Graninger et al. ..... 200/50.02

FOREIGN PATENT DOCUMENTS

FR 2 050 648 4/1971 ..... H01H/5/00
GB 1104218 2/1968 ..... H01H/13/02
WO WO 96/12290 4/1996 ..... H01H/11/00

* cited by examiner

*Primary Examiner*—Michael Friedhofer
(74) *Attorney, Agent, or Firm*—Parkhurst & Wendel, L.L.P.

(57) ABSTRACT

Multipole contact block with sudden disconnection utilisable in a position switch or a push button. The contact parts have connection lands set according to three connection planes (P1–P3) and the movable element has two contact bridges located in a frontal plane PR to co-operate with the end connection planes P1, P3, as well as one or two other contact bridges located in another frontal plane PF to co-operate with the median connection plane P2, in such a way as to enable "normally open" or "normally closed" functions of the contacts associated with the median connection plane P2.

8 Claims, 3 Drawing Sheets

MULTIPOLE CONTACT BLOCK

FIELD OF THE INVENTION

The present invention relates to a three-pole contact block, in particular with sudden disconnection and positive opening, utilisable in a switch sensitive to a pushing movement, in particular a position switch, a push button or analogous element.

BACKGROUND OF THE INVENTION

Generally, such blocks comprise a casing for housing fixed contact parts terminated at one end by connection lands and carrying at another end a fixed contact together with a movable element provided with several contact bridges in such a way as to have at least one opening pole and one closure pole with the fixed contacts. The movable element is subjected to a push-button on the one hand and a spring system on the other, the whole being fitted to produce a positive opening and sudden opening and closure.

It is known from prior art how to implement a contact block in a multipole switch with a push button which acts upon a contact carrier with several superposed bridges, the bridges being mounted in a reversible way in order to ensure a "normally open" (NO) or "normally closed" (NC) function with the corresponding pole.

In certain cases it is preferable to confer to one of the poles of a three-pole switch an NO or NC function without having to modify the contact carrier.

SUMMARY OF THE INVENTION

The aim of the invention is to enable a multipole contact block to operate with at least one pole switchable from normally open state to normally closed state or the reverse, without modification of the layout of the contact carrier.

According to the invention, the connection lands are laid out according to at least three distinct connection planes, and the movable element has at least three contact bridges separated in such a way as to cooperate with fixed contacts located in two transversal contact planes and to move in two frontal planes; two contact bridges which are situated in the first frontal plane co-operating with fixed contact parts protruding on two connection planes, and the third contact bridge which is situated in the second frontal plane cooperating with the fixed contact parts protruding on the third connection plane. The third connection plane is in particular located in a median position between the two first connection planes.

Preferably the contact block is three-pole and the movable element that has four contact bridges with a balanced symmetrical arrangement, the fourth contact bridge being located in the second frontal plane and not co-operating with the fixed contact parts.

The movable element can be substituted at the fourth contact bridge by an elastic or mobile support part located in the second frontal plane relative to the third contact bridge located in this plane, so as to be displaced at the same time as the contact bridge located in the same transversal plane.

Advantageously the contact bridges located at different levels in a same frontal plane are acted upon by a single compression spring tending to separate them from each other.

In a simplified assembly embodiment, the movable element is mounted in the casing by introduction via an open rear face of the casing and a base is assembled, preferably clipped together with the casing to cover the rear face. The base can then have lugs or analogous maintenance elements which bear against the fixed contact parts ending at the rear plane to help to maintain them in a very simple way. A cover for insulating the terminals can be set, in particular clipped, on the front face of the casing.

BRIEF DESCRIPTION OF THE DRAWINGS

The following description relates to a non-limiting embodiment of the invention, relative to the attached drawings.

DISCLOSURE OF THE INVENTION

The three-pole contact block shown in the figures comprises a casing 10 in insulating material which houses six conducting parts 11, 12, 13, 14, 15, 16 carrying fixed contacts and a movable element 17 with positive opening and sudden opening and closure, the element being guided inside this casing and provided with mobile contacts which co-operate with the fixed contacts.

Figure 1:
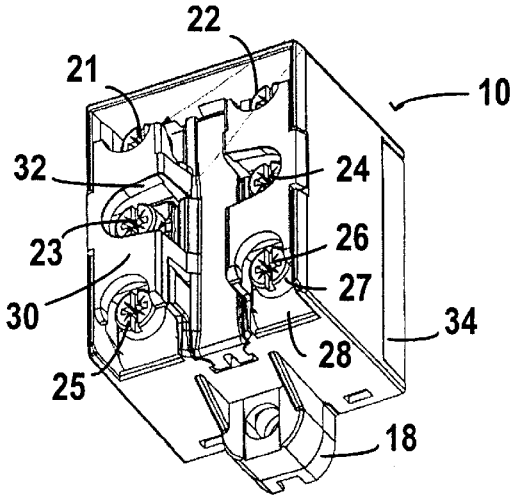
FIG. 1 shows a contact block according to the invention, in perspective.
Figure 6:
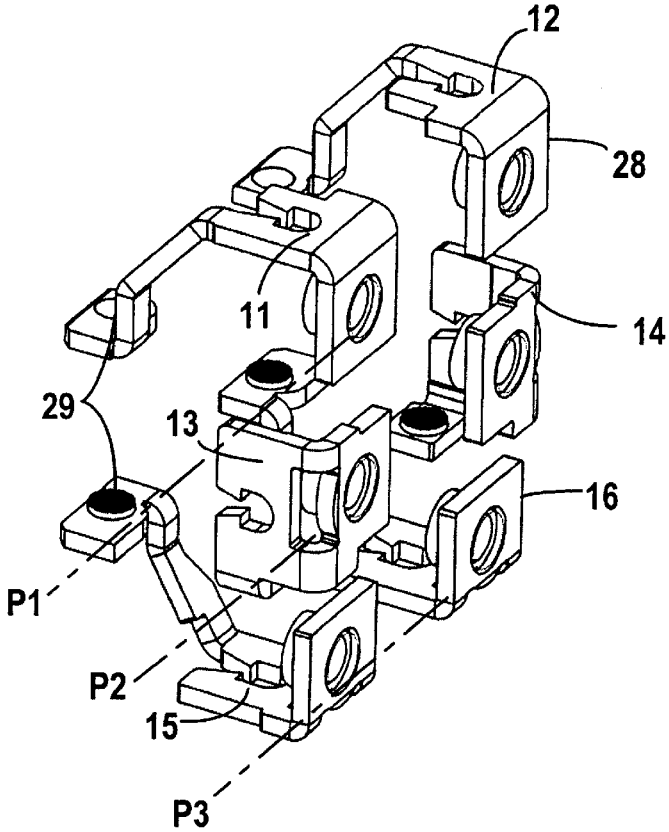
FIG. 6 is a view of the fixed conducting parts only, in perspective.
Figure 5:
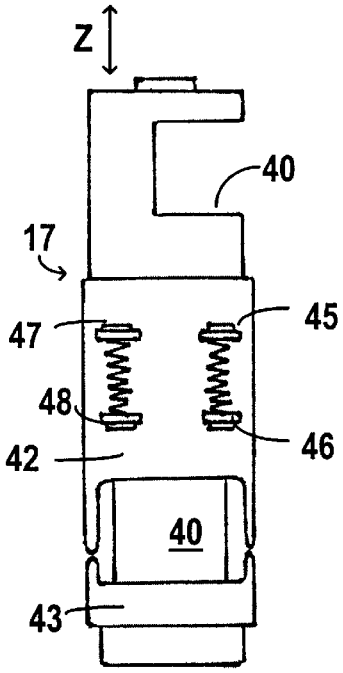
FIG. 5 shows a side view of the movable element of the block.
Figure 2:
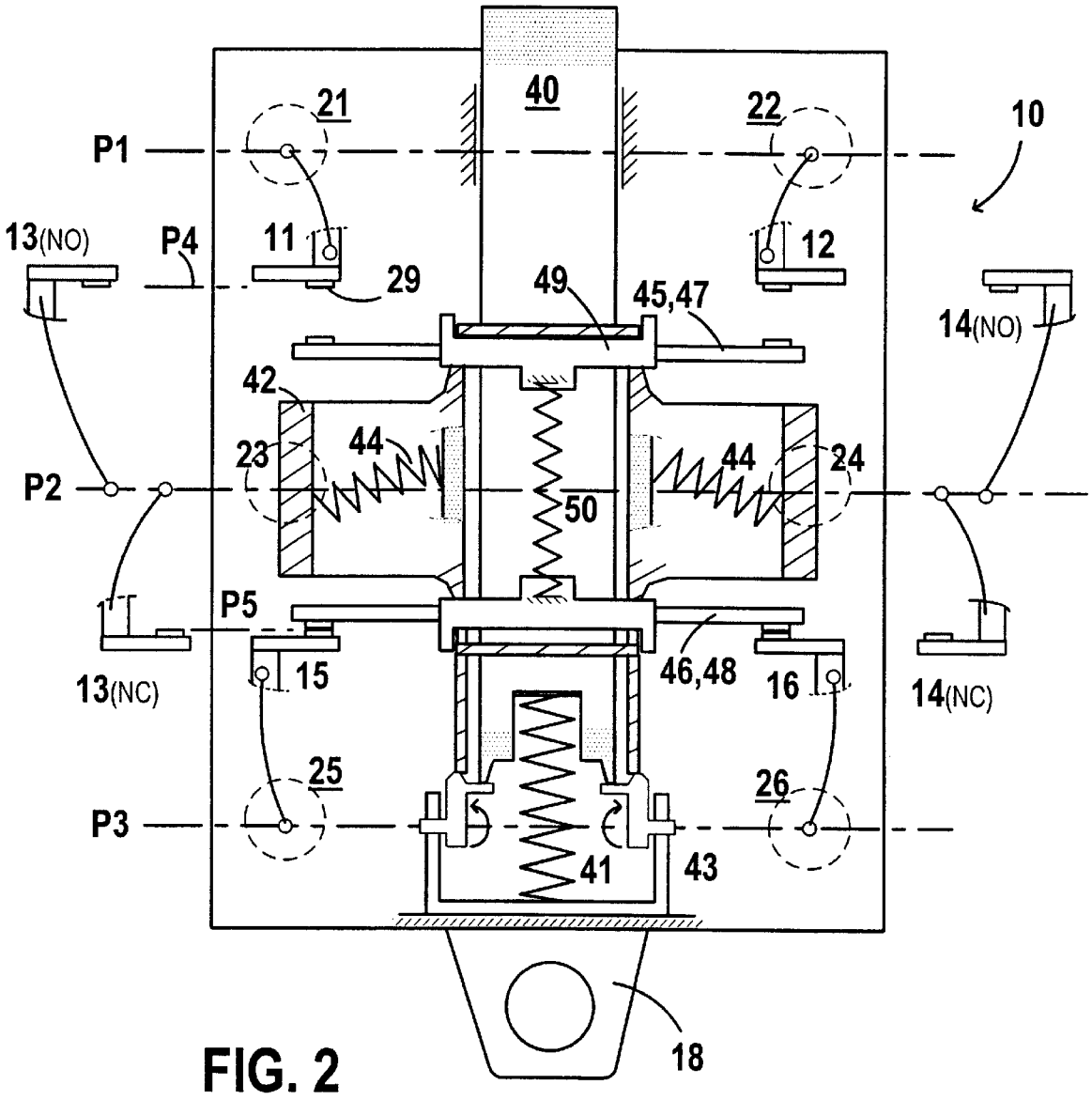
FIG. 2 is a diagram of a front view of a part of the block.

The casing 10 is quadrangular in shape and towards the front has three groups of two terminals 21, 22, 23, 24, 25, 26 divided over three respective connection planes P1, P2, P3. Each terminal 21–26 comprises a screw 27 for tightening the cable (or an elastic tightening part) co-operating with a connection land 28 of the corresponding conducting part 11–16. The conducting parts 11, 12 and 15, 16 associated with the terminals 21, 22 and 25, 26 located in the end connection planes P1, P3 are preferably identical; the conducting parts 13, 14 associated with the median terminals 23, 24 of the median plane P2 differ from the other conducting parts and are preferably identical to each other (see FIG. 6).

At their end opposite to the connection land 28, the parts 11–16 terminate by a fixed contact 29 under the form of a pad; the contact pads 29 of parts 11, 12, 15, 16 are located in a rear frontal plane PR (parallel to the base and to the front face of the block and perpendicular to the planes P1–P3) and those of parts 13, 14 are located in a fore frontal plane PF parallel to PR. Heightwise, the pads 29 of the parts 11, 12 are located in an intermediate plane P4 between P1 and P2 and those of parts 15, 16 are located in an intermediate plane P5 between P2 and P3; the pads of parts 13, 14 are located in the plane P4 or P5 according to the configuration chosen for the block, as will be described below.

The casing 10 of the block provides a fixation lug 18, for example to be housed in a position switch body. The casing 10 is covered in front by a clippable cover 30 which ensures a function of protection and impermeability of the terminal screws. The cover 30 has a wall 31 forming the front face of the block while allowing access to the screws, as well as the inter-terminal insulation partitions 32 and lateral notches for clipping onto the front edges of the block. The casing 10 has an open face 33 at the rear which allows introduction of the contact block and which is closed by a clippable base 34. The base 34 has a flat wall provided with lugs 35, towards the interior of the block, which ensure maintenance of the rear fixed contact parts 11, 12, 13, 14. Instead of lugs, one can provide shoulders or other analogous forms of maintenance. The base 34 also comprises clipping lugs 36 on the casing.

The movable element 17 is able to generate a positive opening of the contacts. It comprises a push button 40 which can be displaced along a direction Z parallel to the planes PF, PR and, subjected to a return spring 41 as well as a contact carrier 42 with sudden movement, also movable along Z. The contact carrier 42 is mounted to be mobile in to-and-fro motion on the push button and is subjected to a return part 43. This return part, by means of movement reversing levers, transforms a lowering movement of the push button into a rising movement of the contact carrier. The rising movement of the contact carrier 42 is caused to be sudden with the aid of two lateral springs 44 when passing the dead point position. The mechanism described in already known from prior art is not the subject of the invention.

Four contact bridges 45, 46, 47, 48 are set out in a symmetric and balanced manner on or in the contact bridge 42 in such a way as to be able to be displaced relative to the latter along Z. The planes of symmetry of the bridges are the same as the front planes PF and PR. The bridges 45, 46 are located in the plane PR and the bridges 47, 48 in the plane PF; the bridges 45, 47 on the one hand, and the bridges 46, 48 on the other hand, are located in two distinct planes parallel to P1-P3, in such a way as to be able to co-operate respectively with the parts 11, 12 (bridge 45), 15, 16 (bridge 46), 13, 14 (bridge 47 or bridge 48 according to the assembly adopted for parts 13, 14). Each bridge has, in the middle, a cast moulded insulated part 49 which facilitates guiding it in the contact carrier. Between the bridges 45, 46 on the one hand and the bridges 47, 48 on the other, a compression spring 50 is provided which bears directly on the bridges and tends to separate them from each other to ensure clearance compensation and good contact pressure, particularly at the moment of switchover. As a variant, in the place of one of the front bridges 47, 48 one can provide an elastic or mobile support part 51 (see FIG. 4), for example an elastic blade able to simulate, when the movable element 17 is activated, the retraction movement of the bridge for which it is substituted and to follow the movement of the rear bridge located at the same level.

The bridges 45, 47 form, together with the corresponding fixed contacts, normally open poles (NO) and the bridges 46, 48 form, together with the corresponding fixed contacts, normally closed poles (NC).

Figure 3:
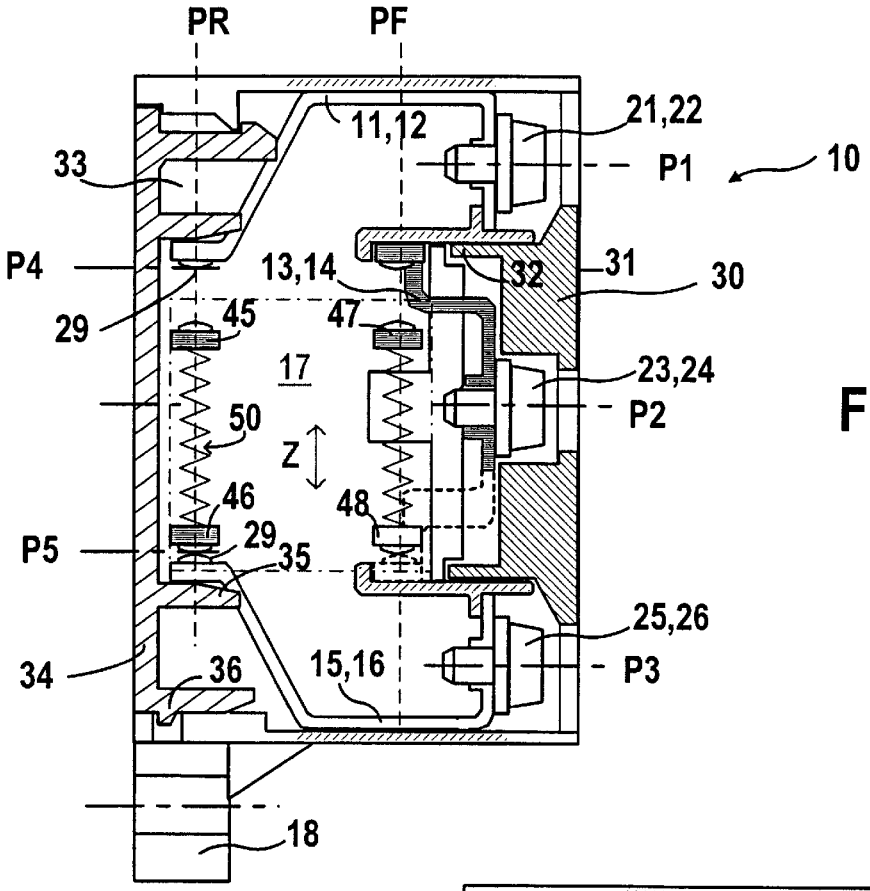
FIGS. 3 and 4 are diagrams from the side of the block, with movable elements removed, in two different configurations.
Figure 4:
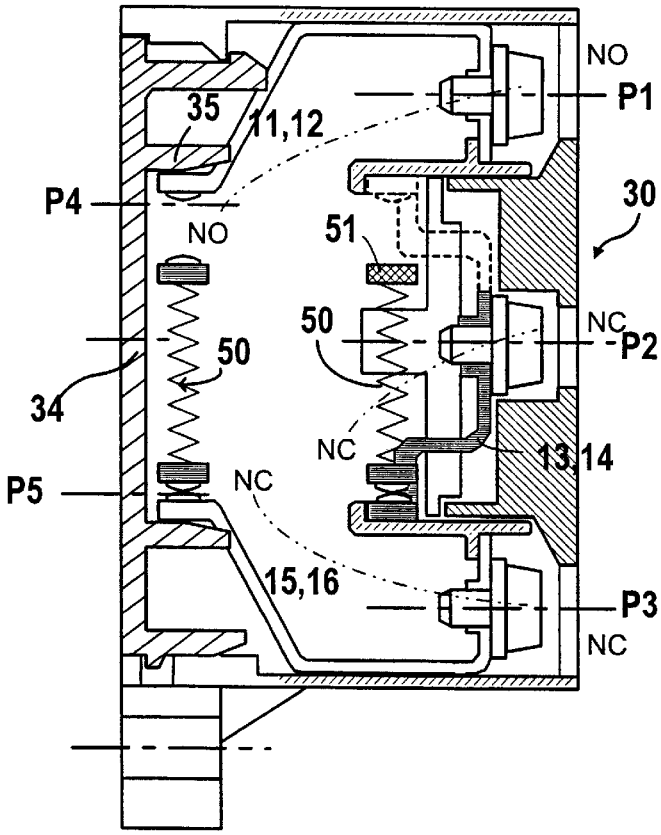

The block described is assembled in the following way. The fixed contact parts are set in the casing 10, and then the movable element is inserted from the back into the casing and the base 34 is clipped onto the casing. The two configuration possibilities of the block are illustrated in FIGS. 3 and 4. In the version of FIG. 3, the fixed contact parts 13, 14 are set with their contact pads in the plane P4 to form an NO pole. In the version of FIG. 4 the parts 13, 14 are set with their contact pads in the plane P5 to form an NC pole. Furthermore, in the version of FIG. 4 the bridge 47 has been replaced by an elastic support part for the spring 50. The parts 13, 14 of the NO version can be identical to the parts 13, 14 of the NC version, such that one passes from one version to the other by simple turnover, or they can be different. In the same way, the casing 10 of the version NO-NO-NC of the contact block can be identical to the casing of the version NO-NC-NC of the block or can be different.

What is claimed is:

1. A multipole contact block, with positive opening and sudden opening and closure, for use in a switch sensitive to a pushing movement, comprising:

a casing having located therein a plurality of fixed contact parts, each terminated at one end thereof by a connection land, and terminated at another end thereof by a fixed contact together with operatively connected to a movable element comprising a push button, a system of springs, and plurality of contact bridges together with the fixed contacts comprising at least one opening pole and one closure pole with the fixed contacts, wherein:

the connection lands are arranged according to at least three distinct connection planes (P1–P3), and the movable element has at least three contact bridges arranged to make contact in two transversal contact planes (P4, P5) and to move in two frontal planes (PF, PR);

two contact bridges of said plurality of contact bridges are located in a first frontal plane (PR) for co-operating with the fixed contact parts protruding on two of the connection planes (P1, P3); and the third contact bridge of said plurality of contact bridges is located in the second frontal plane (PF) for co-operating with the fixed contact parts protruding on the third connection plane (P2).

2. The contact block according to claim 1, wherein the contact block comprises a three-pole contact block, the movable element comprises four contact bridges with a balanced symmetrical layout, and a fourth contact bridge of said plurality of contact bridges is located in the second of said two frontal planes and not co-operating with the fixed contact parts.

3. Contact The contact block according to claim 1, wherein the movable element comprises an elastic or movable support part substituted for a fourth contact bridge in the second frontal plane (PF), facing the third contact bridge located in the second frontal plane, for displacement simultaneously with displacement of the contact bridge located in the same transversal plane.

4. The contact block according to claim 1, wherein the third connection plane (P2) is located in a median position between the two first connection planes (P1, P2).

5. The contact block according to claim 1, further comprising a single compression spring, wherein the contact bridges located at different levels in a same frontal plane are acted on by the single compression spring tending to separate said contact bridges from each other.

6. Contact The contact block according to claim 1, wherein said casing comprises an open rear face for introducing the movable element for mounting in the casing, and a base for attachment to the casing to cover the rear face.

7. The contact block according to claim 6, wherein the base includes lugs for bearing against the fixed contact parts located at the rear face to facilitate maintenance.

8. The contact block according to claim 1, further comprising a cover for insulating the terminals the cover attached to a front face of the casing.

* * * * *